US005441580A

United States Patent [19]

Tomlinson

[11] Patent Number: 5,441,580

[45] Date of Patent: Aug. 15, 1995

[54] HYDROPHILIC COATINGS FOR ALUMINUM

[75] Inventor: Charles E. Tomlinson, Martinsville, Ind.

[73] Assignee: Circle-Prosco, Inc., Bloomington, Ind.

[21] Appl. No.: 138,136

[22] Filed: Oct. 15, 1993

[51] Int. Cl.[6] ..... C23C 22/44

[52] U.S. Cl. ..... 148/247

[58] Field of Search ..... 148/247

[56] References Cited

U.S. PATENT DOCUMENTS

| | | | |
|---|---|---|---|
| 3,682,713 | 8/1972 | Ries et al. . | |
| 3,964,936 | 6/1976 | Das . | |
| 4,148,670 | 4/1979 | Kelly . | |
| 4,273,592 | 6/1981 | Kelly . | |
| 4,277,292 | 7/1981 | Tupper . | |
| 4,313,769 | 2/1982 | Frelin et al. . | |
| 4,326,894 | 4/1982 | Konnert . | |
| 4,338,140 | 7/1982 | Reghi . | |
| 4,470,853 | 9/1984 | Das et al. . | |
| 4,617,068 | 10/1988 | King . | |
| 4,786,336 | 11/1988 | Schoener et al. . | |
| 4,816,086 | 3/1989 | Oleske . | |
| 4,921,552 | 5/1990 | Sander et al. . | |
| 4,992,116 | 2/1991 | Hallman . | |
| 5,123,978 | 6/1992 | Balin et al. . | |
| 5,139,586 | 8/1992 | Das . | |
| 5,342,456 | 8/1994 | Dolan | 148/247 |

FOREIGN PATENT DOCUMENTS

| | | | |
|---|---|---|---|
| 737705 | 9/1955 | United Kingdom | 148/247 |
| WO85/65131 | of 1985 | WIPO . | |

*Primary Examiner*—Sam Silverberg

[57] ABSTRACT

A chromium-free conversion coating for aluminum finstock includes zirconium, fluoride and potassium ions. The coating is preferably at a pH below about 2.0, and may optionally include polyphosphates, tannin, boron and zinc. A sequestering agent to complex dissolved iron, and a crystal deformation agent such as ATMP are also preferably included.

28 Claims, No Drawings

HYDROPHILIC COATINGS FOR ALUMINUM

FIELD OF THE INVENTION

The present invention relates generally to chromium-free coatings for metal surfaces, and more particularly to hydrophilic coatings for aluminum finstock.

BACKGROUND TO THE INVENTION

A variety of chemical conversion coatings for aluminum are known to the art. These conversion coatings provide a corrosion resistant outer layer to the metal while often simultaneously providing improved paint or other organic coating adhesion. Conversion coatings may be applied by a "no-rinse" process in which the metal surface to be coated is cleaned and the conversion coating is dipped, sprayed or rolled on, or they may be applied as one or more coats which are subsequently rinsed from the metal surface.

Many conversion coatings are chromate-based compositions. Recently, chromate-free conversion coatings have also been developed. These coatings are particularly useful for applications, such as coating aluminum food or beverage cans, in which it is particularly desirable to avoid potentially toxic chromates. Chromate-free conversion coatings typically employ a Group IVA metal such as titanium, zirconium or halfnium, a source of fluoride ion and nitric acid for pH adjustment. These chromate-free conversion coatings are substantially clear and prevent the blackening that normally occurs when aluminum is boiled in water during pasteurization.

For example, U.S. Pat. No. 3,964,936 to Das discloses the use of zirconium, fluoride, nitric acid and boron to produce a conversion coating for aluminum. U.S. Pat. No. 4,148,670 to Kelly discloses a conversion coating comprising zirconium, fluoride and phosphate. U.S. Pat. No. 4,273,592 to Kelly discloses a coating comprising zirconium, fluoride and a $C_{1-7}$ polyhydroxy compound, wherein the composition is essentially free of phosphate and boron. U.S. Pat. No. 4,277,292 to Tupper discloses a coating comprising zirconium, fluoride and a soluble vegetable tannin.

U.S. Pat. No. 4,338,140 to Reghi discloses a conversion coating comprising zirconium, fluoride, vegetable tannin and phosphate, and optionally including a sequestering agent to complex hard water salts such as calcium, magnesium and iron. U.S. Pat. No. 4,470,853 to Das et al. discloses a coating comprising zirconium, fluoride, vegetable tannin, phosphate and zinc. U.S. Pat. No. 4,786,336 to Schoener et al. discloses a coating comprising zirconium, fluoride and a dissolved silicate, while U.S. Pat. No. 4,992,116 to Hallman discloses a conversion coating comprising a fluoroacid of zirconium and a polyalkenyl phenol.

It can be seen from the above that the compositions of the prior art have not combined in high concentrations (up to the respective solubility limits) Group IA metals such as potassium with Group IVA metals such as zirconium to provide hydrophilic coatings.

It should further be noted that the conversion coatings of the prior art have not proven particularly effective for certain applications. For example, aluminum finstock used for heat exchange units, such as evaporators, has not been effectively treated using known chromate-free coatings. A need therefore exists for improved conversion coatings for providing a hydrophilic surface to aluminum finstock. The present invention addresses that need.

SUMMARY OF THE INVENTION

The present invention provides improved conversion coatings based on Group IVA metals by combining the Group IVA metal with one or more Group IA metal. In one aspect of the invention, an aqueous conversion coating is provided comprising between about 1,000 and 15,000 ppm zirconium, between about 1000 ppm and about 10,000 ppm potassium, and between about 5,000 ppm and about 20,000 ppm fluoride in a highly acidic medium. The coating may optionally include polyphosphates, tannin, boron and zinc; a sequestering agent to complex dissolved iron, and a crystal deformation agent such as ATMP may also be included.

One object of the present invention is to provide very hydrophilic conversion coatings for aluminum finstock.

Further objects and advantages of the present invention will be apparent from the following description.

DESCRIPTION OF THE PREFERRED EMBODIMENT

For the purpose of promoting an understanding of the principles of the invention, reference will now be made to preferred embodiments and specific language will be used to describe the same. It will nevertheless be understood that no limitation of the scope of the invention is thereby intended, such alterations and further modifications in the illustrated embodiments, and such further applications of the principles of the invention as illustrated herein being contemplated as would normally occur to one skilled in the art to which the invention pertains.

As indicated above, the present invention relates generally to chromate-free compositions which provide a highly hydrophilic coating on the surface of metal substrates. In particular, coatings based on Group IVA metals such as zirconium are disclosed. The inventive compositions produce a hydrophilic coating on aluminum while providing a surface that gives improved adhesion of paint and other organic coatings.

In one aspect of the present invention a hydrophilic conversion coating is provided comprising a Group IVA metal such as titanium, zirconium or halfnium, a Group IA metal such as potassium, and a source of fluoride ions. The composition is preferably provided at a pH below 2.0 and preferably between 0.1 and 1.0.

As indicated, the Group IVA metal may be titanium, zirconium or halfnium. (Group IVA refers to the IUPAC nomenclature; the corresponding CAS designation for these metals is Group IVB. Alternatively, these metals may be designated merely as Group 4.) In most applications zirconium is used, due primarily to its commercial availability and lower cost. Other Group IVA metals may be used as desired for a particular commercial application.

The zirconium or other Group IVA metal is provided in ionic form which is easily dissolved in the aqueous coating composition. For example, $K_2ZrF_6$, $H_2ZrF_6$ or $Zr(O)(NO_3)_2$ may effectively be used. Note that the source of Group IVA metal ion may also be a source of fluoride ion, commonly an alkali metal fluorozirconate salt. Potassium hexafluorozirconate is most preferred.

The Group IA metal may be lithium, sodium, potassium, etc., with potassium being preferred in one embodiment. The Group IA metal may be provided as any of the many inorganic salts available, including the nitrates, sulfates, fluorides, etc. For example, KF, KNO3, etc., may be used, with potassium fluoride being most preferred in one embodiment.

A source of fluoride ion is also included to keep the metals in solution and react with the substrate. The fluoride may be added as an acid (e.g., HF), as any of the many fluoride salts (e.g., KF, NaF, etc.), as the complex metal fluoride of the Group IVA metal, or in any other form which will donate fluoride to the working solution. Most preferably the fluoride is added as $H_2ZrF_6$ and KF.

The fluoride is preferably present in a molar ratio of at least 6 moles fluoride to each mole of Group IVA metal. The concentration of fluoride in the working solution is selected such that the metals remain soluble. The particular fluoride level is also selected according to the pH and metal concentration, knowing that the fluoride will move from the higher order metal fluorides to the lower order and preferentially to the metallic (oxide) surface. A small amount of etching of an oxide surface is acceptable, but much of the metal oxide present on the surface prior to coating should be maintained to prevent buildup of the basis metal in the treatment solution.

The pH of the coating is normally between about 0 and 2.0, preferably between about 0.1 and 1.0, most preferably between about 0.2 and 0.5. The pH may be adjusted by adding a Group IVA metal acid, an acid fluoride, or other mineral acids such as $HNO_3$, $H_2SO_4$, etc. Most preferably, $HNO_3$ is used. Generally, higher levels of metal concentration necessitate lower pH levels and, with increasing levels of metal and acid, a heavier coating is obtained under these conditions.

The temperature of the working solution preferably ranges from about 70° F. to about 160° F. Appropriate working solution temperatures for particular applications may be selected by persons skilled in the art without undue experimentation.

Working solutions can be made up to the solubility limits of the components in,combination to provide acceptable coatings. Acceptable coatings can be formed from solutions containing from 0.01 M to 0.25 M Group IVA metals, with 0.05 M to 0.30 Group IA metals. The best ratio of Group IVA to Group IA metal depends on the method of coating solution contact (spray, dip, flood, etc.), working bath temperature, pH, and fluoride concentration. For example, for a five second immersion at 70° F. to 90° F.; 3,000 to 7,000 ppm Zr, 3,000 to 8,000 ppm K and 8,000 to 12,000 ppm $F^-$, gives superior hydrophilicity to aluminum.

In a second aspect of the invention the quality of the coating is improved by adding, e.g., phosphates, polyphosphates, tannin, aluminum, boron, zinc, a sequestering agent to complex dissolved iron, and a crystal deformation agent such as ATMP.

The addition of phosphate to the working bath also adds to corrosion protection and paint adhesion of the coating obtained. It is commonly believed that the incorporation of phosphate into certain conversion coatings enhances protection from "pitting" corrosion; as when a pit is initiated in a corrosive environment, the phosphate present will first dissolve into the pit area and, there, form insoluble salts with base (substrate) metal ions or other coating components, effectively sealing the pit.

Organic additives such as tannic acid or vegetable tannins in plating and chemical conversion coating systems are beneficial in promoting uniformity of coating, organic coating adhesion, and corrosion resistance. Tannic acid and vegetable tannins may be incorporated into the treatments disclosed here and do give the benefits listed above. Tannic acid shows beneficial effects in a very broad range, from 5 ppm to its solubility limit. At higher levels, the coating becomes very golden brown as much of the tannate has become incorporated into the coating. Optimum levels of tannic acid and vegetable tannins are from 10 to 50 ppm.

The addition of boron in the form of boric acid or a borate salt to the working solution improves certain properties of the coating, such as corrosion resistance. The preferred range for boron is 5 to 50 ppm; typically 10 to 20 ppm boron is present.

The addition of zinc to the working solution produces coatings with improved corrosion resistance. The preferred range for zinc is 5 to 100 ppm, most preferably 10 to 30 ppm.

Aluminum added to the working solution increases the rate of deposition of insoluble salts in the coating. Aluminum may be added in any form of soluble aluminum salt, preferably as a hydrated aluminum nitrate. Preferably, aluminum may be present at 10 to 1000 ppm, most preferably at 20 to 40 ppm.

Working solutions composed of mixture(s) of the above components may be applied by spray, dip, or roll coat application. After the coating has formed, the surface should be rinsed with clean water. The rinse(s) may be deionized or tap water and should remove any soluble salts which might be present on the surface.

The surface obtained is hydrophilic and may be coated with an organic or silicate coating. Adhesion is improved with organic coatings. Treatment with a silicate, preferably a 1 to 15 weight % sodium silicate solution, considerably extends the life of the metallic substrate in a corrosive environment.

It is to be appreciated that siccative coatings which form an organic barrier may also be necessary for decorative purposes of the final product. Silicates (such as Sodium Silicate Grade #40 at 0.5% to 20% in water) deposit and react with the formed coating to provide additional corrosion protection while maintaining a hydrophilic surface. The silicate drys and forms a network of siloxyl linkages. The corrosion protection is enhanced by the silicate as with the siccative type coatings. The siccative type coatings usually leave a surface which is hydrophobic.

Reference will now be made to specific examples using the processes described above. It is to be understood that the examples are provided to more completely describe preferred embodiments, and that no limitation to the scope of the invention is intended thereby.

EXAMPLE 1

A conversion coating was prepared to a total volume of 1 liter in distilled water as follows. Potassium hexafluorozirconate (15.0 grams $K_2ZrF_6$ per liter, providing 4876 ppm Zr), was added to 0.10 gram $H_3BO_3$, 5 grams $KF.2H_2O$, 60 ml of 70% HF in aqueous solution.

EXAMPLE 2

Aluminum panels were treated with the solution of Example 1 for 10 seconds at room temperature by immersion. Bubbling on the substrate stopped during this period, indicating the reaction with the oxide layer had ended and a barrier coating was deposited. The panel was rinsed with tap water and dried at 300° F. for 1 minute. The surface proved to be very hydrophilic, a tightly bound coating was produced.

EXAMPLE 3

The solution of Example 1 was used to coat 0.0045 inch thick 1100-0 aluminum on a 14 inch coater/laminator with a 300 Q and a 220 QCH gravure roller. The coating was applied at up to 150 feet per minute and allowed to react with the substrate for 5 seconds before drying at 275° F. The metal so treated passed requirements for hydrophilicity, corrosion resistance, and a 30 hour running water test.

We claim:

1. An aqueous composition for coating aluminum finstock, comprising:

(a) between about 1,000 ppm and about 15,000 ppm, based on the aqueous composition, of dissolved Group IV ions;

(b) between about 1,000 ppm and about 10,000 ppm, based on the aqueous composition, of dissolved Group I ions;

(c) between about 5,000 ppm and about 20,000 ppm, based on the aqueous composition, of dissolved fluoride, ions;

(d) sufficient mineral acid to adjust the pH of the solution to less than about 1.0; and (e) water; said aqueous composition being chromium free.

2. A coating composition according to claim 1 wherein said Group I ions are potassium ions.

3. A coating composition according to claim 1 wherein the mineral acid is hydrofluoric acid.

4. A coating composition according to claim 2 wherein said potassium ions are present in the amount of between about 4,000 ppm and about 8,000 ppm of the aqueous composition.

5. A coating composition according to claim 2 wherein said potassium ions are present in the amount of between about 5,000 ppm and about 6,000 ppm of the aqueous composition.

6. A coating composition according to claim 1 wherein said Group IV ions are zirconium ions.

7. A coating composition according to claim 6 wherein said zirconium ions are present in the amount of between about 2,000 ppm and about 10,000 ppm of the aqueous composition.

8. A coating composition according to claim 7 wherein said zirconium ions are present in the amount of between about 4,000 ppm and about 6,000 ppm of the aqueous composition.

9. A coating composition according to claim 1, and further including a source of tripolyphosphate ions.

10. A coating composition according to claim 9 wherein said source of tripolyphosphate ions is sodium tripolyphosphate.

11. A coating composition according to claim 10 wherein said tripolyphosphate ions are present in the amount of between about 10 ppm to about 1,000 ppm.

12. A coating composition according to claim 11 wherein said tripolyphosphate ions are present in the amount of between about 40 ppm to about 400 ppm.

13. A coating composition according to claim 1, and further including at least about 5 ppm of tannic acid or vegetable tannin.

14. A coating composition according to claim 13 wherein said tannic acid or vegetable tannin is present in the amount of about 10 ppm to about 50 ppm.

15. A coating composition according to claim 1, and further including a sequestering agent in an amount effective to complex essentially all dissolved iron present in the composition.

16. A coating composition according to claim 1, and further including a source of boron.

17. A coating composition according to claim 16 wherein said boron is present in the amount of between about 5 ppm to about 50 ppm.

18. A coating composition according to claim 17 wherein said boron is present in the amount of between about 10 ppm to about 20 ppm.

19. A coating composition according to claim 1 and further including phosphoric acid or a phosphate salt in an amount effective to provide a phosphate concentration of between about 5 ppm to about 300 ppm.

20. A coating composition according to claim 19 wherein said acid or phosphate salt is present in an amount effective to provide a phosphate concentration of between about 50 ppm to about 300 ppm.

21. A coating composition according to claim 1 and further including zinc ion at a concentration of between about 5 ppm to about 100 ppm.

22. A coating composition according to claim 21 wherein said zinc ion is present at a concentration of between about 10 ppm to about 30 ppm.

23. A coating composition according to claim 1 wherein said composition has a pH below 0.50.

24. A coating composition according to claim 1 and further including a crystal deformation agent.

25. A coating composition according to claim 24 wherein said crystal deformation agent is nitrilotris (methylene) triphosphonic acid (ATMP).

26. A method of treating metal, comprising applying to the metal a chromium-free aqueous coating composition comprising:

(a) between about 1,000 ppm and about 15,000 ppm, based on the aqueous composition, of dissolved Group IV metal ions;

(b) between about 1,000 ppm and about 10,000 ppm, based on the aqueous composition, of dissolved Group I metal ions;

(c) between about 5,000 ppm and about 20,000 ppm, based on the aqueous composition, of dissolved fluoride ions;

(d) sufficient mineral acid to adjust the pH of the solution to less than about 1.0; and (e) water.

27. A method according to claim 26 wherein said Group IV metal ion is zirconium ion.

28. A method according to claim 26 wherein said Group I metal ion is potassium ion.

* * * * *